United States Patent [19]

Twitchell

[11] 4,046,357

[45] Sept. 6, 1977

[54] SHOTCRETE ACCELERATOR INJECTION APPARATUS AND METHOD

[75] Inventor: F. Shawn Twitchell, Salt Lake City, Utah

[73] Assignee: Construction Systems & Equipment, Inc., Salt Lake City, Utah

[21] Appl. No.: 747,387

[22] Filed: Dec. 3, 1976

[51] Int. Cl.[2] ..... B28C 1/02; B28C 5/46

[52] U.S. Cl. ..... 259/147; 239/304; 259/151

[58] Field of Search ..... 259/147, 153, 151, 164, 259/165, 169, 4 R, 18, 36; 239/304, 527

[56] References Cited

U.S. PATENT DOCUMENTS

| | | | |
|---|---|---|---|
| 2,577,664 | 12/1951 | Pro | 259/151 |
| 2,758,945 | 8/1956 | Widmayer | 259/147 |
| 3,212,759 | 10/1965 | Brown | 259/151 |
| 3,248,093 | 4/1966 | Demaison | 259/151 |
| 3,705,710 | 12/1972 | Mueller | 259/151 |
| 3,931,959 | 1/1976 | Truman | 259/151 |
| 3,938,786 | 2/1976 | Bernold | 259/151 |

*Primary Examiner*—Robert W. Jenkins
*Attorney, Agent, or Firm*—Trask & Britt

[57] ABSTRACT

An air driven positive displacement pump is positioned to take a suction from a source of shotcrete accelerator. A shotcrete applicator tube receives pressurized shotcrete from a source thereof. A manifold is adapted to the applicator which has a first inlet connected to the output of the pump to receive accelerator at a pressure in excess of the pressure of the shotcrete passing through the applicator. The manifold also has a second inlet connected to an external source of compressed air to receive compressed air at a pressure higher than the pressure of the shotcrete passing through the shotcrete applicator. The manifold has a body in which the accelerator and compressed air from the first and second inlets respectively are intermixed. The manifold has at least two outlets positioned about the applicator to inject the accelerator and air mixture into shotcrete passing therethrough.

12 Claims, 3 Drawing Figures

SHOTCRETE ACCELERATOR INJECTION APPARATUS AND METHOD

BACKGROUND OF THE INVENTION

1. Field

This invention relates to shotcrete application systems and methods. More particularly, this invention provides an apparatus for and a method of injecting shotcrete accelerator into flowing shotcrete within the applicator of a shotcrete application system.

2. State of the Art

It is well known that one of the expanding uses of concrete is in the form of shotcrete. That is, a concrete slurry under pressure is applied to surfaces through a nozzle. Such surfaces may be vertical (e.g., walls) as well as ceiling surfaces. For example, in some circumstances it is desirable to coat the inside of mine tunnels and shafts with shotcrete. So that the concrete (shotcrete) will dry rapidly and adhere to the ceiling and wall surfaces upon which it is sprayed before dripping occurs, a chemical accelerator is mixed into the concrete. The accelerator decreases the set time for the concrete and tends to reduce rebound (splatter) of the shotcrete from the surface upon which it is sprayed.

A wide variety of techniques have been devised to mix the shotcrete accelerator into the shotcrete slurry before application. However, by virtue of the fact that the accelerator decreases the set time (i.e., drying time), the accelerator cannot be mixed into the shotcrete until just before its use. Practically, it is frequently difficult to do so. Yet, mixing the accelerator into the shotcrete slurry too soon will result in a hardening shotcrete slurry which may under certain circumstances become useless because it cannot be sprayed through the nozzle by the virtue of its increased viscosity. Other techniques, including mixing the shotcrete accelerator by mechanical means just prior to or during application, have proven unsatisfactory because of incomplete mixing. Similarly, injecting shotcrete accelerator directly into the flowing shotcrete at some point between its source and its applicator has also proved unsatisfactory because of incomplete mixing. When accelerator is incompletely mixed in with the concrete, portions of the sprayed shotcrete containing a high density of accelerator tend to dry very rapidly while adjoining portions which contain little accelerator drip and run. The shotcrete rebound phenomenon is inevitably more pronounced when the accelerator is incompletely mixed with the concrete.

SUMMARY OF THE INVENTION

Shotcrete accelerator is injected into a flowing shotcrete slurry prior to application thereof. A source of shotcrete accelerator supplies the accelerator at a pressure in excess of the pressure of the shotcrete slurry as it passes through the applicator nozzle of a shotcrete applicator system. Compressed air is obtained from a source thereof and intermixed with the shotcrete accelerator. The compressed air is at a pressure in excess of the pressure of the shotcrete slurry as it passes through the applicator nozzle. The shotcrete accelerator and compressed air intermix in the vicinity of the applicator nozzle. The mixture of accelerator and compressed air is injected into the shotcrete slurry in the shotcrete applicator to intermix with the shotcrete as it passes through the applicator. The shotcrete accelerator and compressed air are preferably supplied at substantially a constant rate of flow and a substantially constant pressure which are adjustable for different rates of shotcrete flow.

The source of shotcrete accelerator is preferably comprised of a reservoir of shotcrete accelerator and a positive displacement air driven pump having an accumulator connected to its output. The pump may be driven by an external source of compressed air from about 25 pounds per square inch to about 150 pounds per square inch.

Apparatus for applying shotcrete includes a source of shotcrete under pressure, a source of shotcrete accelerator and first and second sources of compressed air. The air driven positive displacement pump is connected to the first source of compressed air to be driven thereby. The pump takes a suction from the source of shotcrete accelerator and supplies shotcrete accelerator under pressure to an accumulator. The output of the accumulator is connected to the first inlet of an accelerator injection manifold positioned along the length of the shotcrete which receives shotcrete under pressure from the source thereof. The injection manifold also has a second inlet connected to the second source of compressed air to receive compressed air therefrom. The shotcrete accelerator and compressed air are intermixed in the body of the manifold. A plurality of outlets from the manifold are connected to the nozzle tube to inject the mixture of compressed air and shotcrete accelerator into the shotcrete passing through the nozzle tube.

Preferably, the pump receives compressed air through a pressure regulator connected to receive the compressed air from the first source. The regulator supplies regulated air to control the speed of the pump. The regulator has a filter to filter the compressed air, regulator means to regulate the flow of compressed air to the pump and in turn the speed and output of the pump, and lubricator means to inject lubricant into the regulated compressed air to lubricate the pump.

In a preferred embodiment, the injection manifold has a first valve connected at the first inlet to regulate and stop the flow of shotcrete accelerator and a second valve connected at the second inlet to regulate and stop the flow of compressed air. The manifold preferably has two outlets positioned approximately diametrically opposite each other about the outer surface of the applicator. The first and second sources of compressed air supply compressed air at about 25 pounds per square inch to about 150 pounds per square inch pressure.

In a highly preferred embodiment, the pump exhausts used compressed air through a muffler to quiet the exhaust. The source of shotcrete accelerator is a conventional drum. The pump is positioned on top of the drum and the pump suction is an adjustable tube extending substantially to the bottom of the drum.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
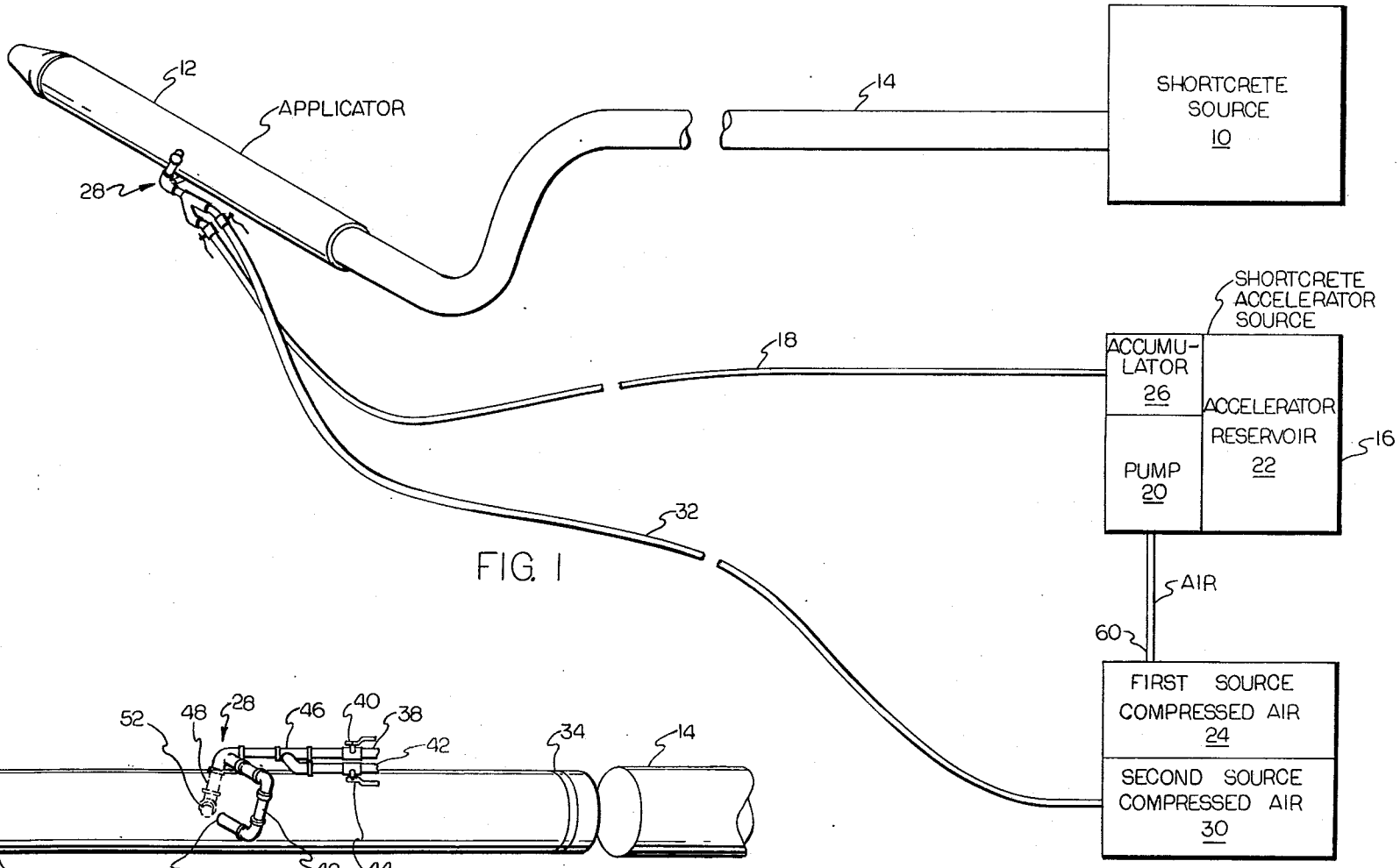
FIG. 1 is a simplified diagram of the apparatus of the instant invention.

FIG. 1 depicts in simplified form a shotcrete applicator system with an accelerator system of the instant invention. In particular, a source of shotcrete 10 is shown connected to a shotcrete applicator 12 by a flexible tube or hose 14. The shotcrete is a slurry of concrete particularly prepared for shotcrete application as known to those skilled in the art. The shotcrete source supplies shotcrete under pressure to the applicator 12. A source of shotcrete accelerator 16 is shown connected by a flexible tube or hose 18 to the applicator 12. The shotcrete accelerator is a chemical compound known to those skilled in the art to accelerate the drying or set time of concrete which is prepared to be shotcrete and to reduce rebound and improve adherence qualities of shotcrete as it is applied. The source of shotcrete as here depicted is comprised of a pump 20 and a reservoir of shotcrete accelerator 22. The pump is an air driven pump which receives compressed air from a first source of compressed air 24. The pump 20 supplies its output to an accumulator 26 which in turn supplies its output through the flexible hose 18 to the applicator 12 through an injection manifold generally depicted by the number 28. A second source of compressed air 30 is also shown supplying compressed air through a flexible tube or hose 32 to the injection manifold 28.

Figure 2:
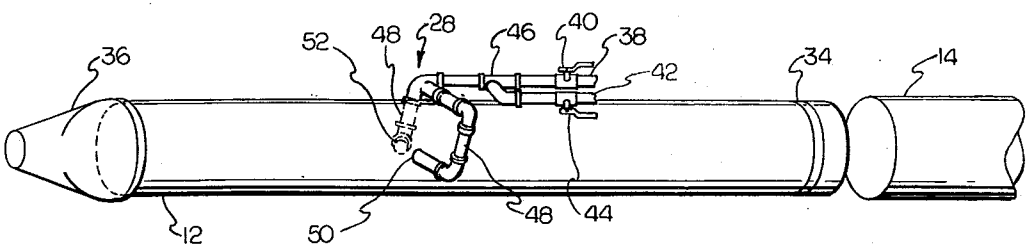
FIG. 2 is a perspective view of a modified applicator of a shotcrete system of the instant invention.

Referring now to FIG. 2, the applicator tube 12 is shown with the applicator injection manifold 28 adapted thereto. The applicator 12 as here illustrated is an elongated tube having a victaulic groove 34 formed at one end to act as a seal for connection with the flexible hose 14 which supplies shotcrete under pressure to the applicator 12. At its other end, the applicator 12 has a venturi tip 36 to supply the shotcrete at a velocity during application. As shown, the accelerator injection manifold 28 is adapted to the tube at its approximate midpoint. The injection manifold 28 includes a first inlet 38 which is connected to the source of shotcrete accelerator by flexible tube 18. The first inlet 38 has a valve 40 associated therewith to act as a flow regulator and stop valve for the shotcrete accelerator. The manifold 28 also has a second inlet 42 connected to receive compressed air by a flexible hose 32. The second inlet also has a stop valve 44 associated therewith to regulate and stop the flow of compressed air. The accelerator and compressed air received from their respective sources intermix in the accelerator injection manifold body 46 for further injection through the manifold piping 48 into the applicator 12. As here shown, the manifold 28 has two outlets 50 and 52 positioned approximately diametrically opposite each other about the circumference of the applicator 12. Those skilled in the art will recognize that a plurality of outlets may be positioned about the circumference of the applicator 12 as desired by the user. The important consideration is that sufficient outlets be provided so that effective mixing of the accelerator and air mixture be effected into the flowing shotcrete within the applicator tube 12.

Figure 3:
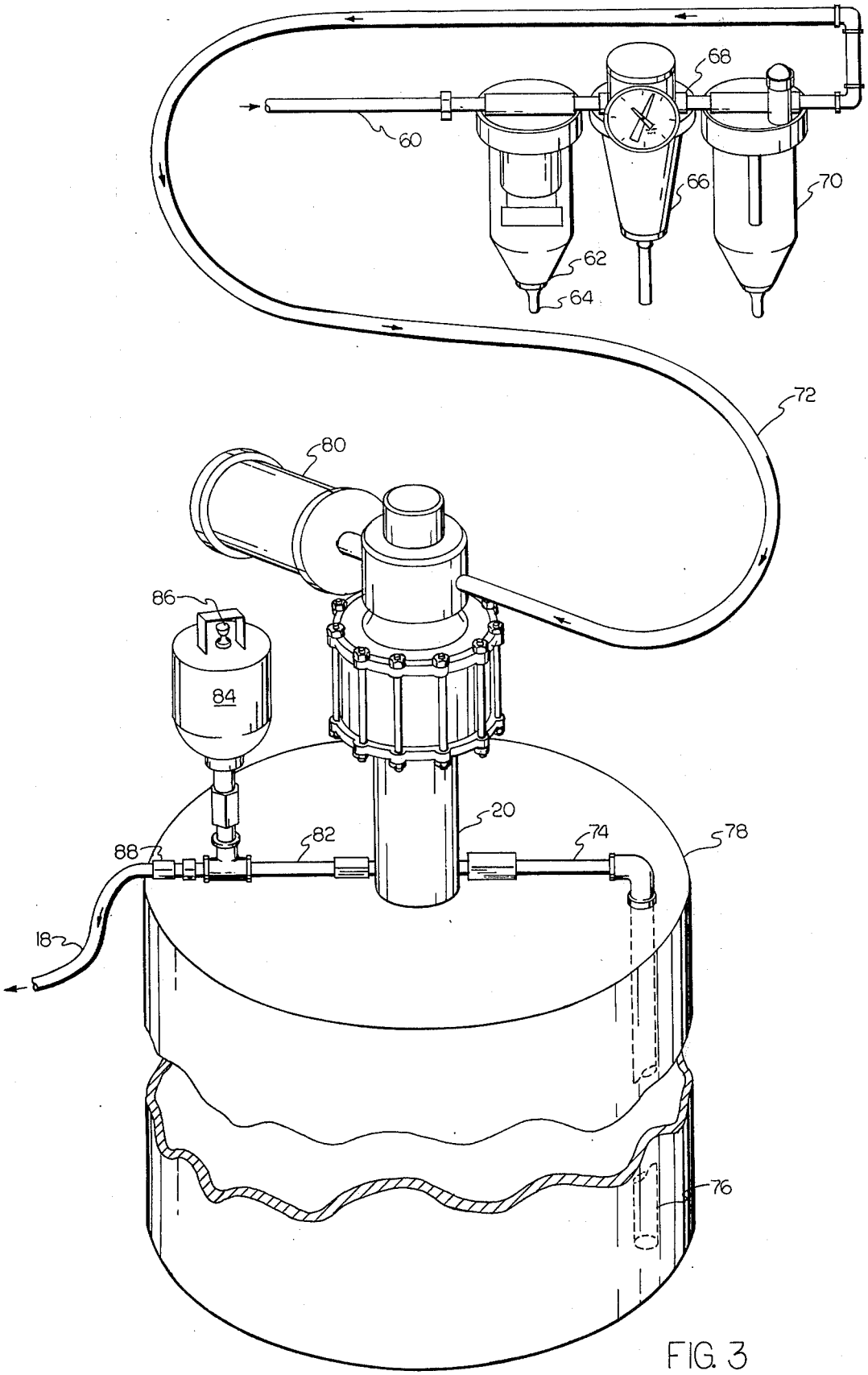
FIG. 3 is a perspective view of the shotcrete accelerator source of the instant invention.

FIG. 3 shows a shotcrete accelerator source. A supply of compressed air is received through the flexible tube or hose 60. The compressed air passes through a filter 62 which filters out water and other impurities. The filter is of conventional type known to those skilled in the art. The filter has a drain 64 associated therewith to vent the filtered impurities. The compressed air then passes through a pressure regulator 66. The regulator may be of any one of numerous conventional regulators which provide for the adjustment of the air pressure at its output 68. The adjustment of the air pressure at its output is necessary to control the speed of the pump 20 as hereinafter discussed. The compressed air then passes from the output of the regulator 68 through the lubricator 70. The lubricator 70 applies small amounts of lubricant to the compressed air to lubricate the cylinder and piston of the pump as known to those skilled in the art. The output of the lubricator 70 is connected by a hose, pipe or flexible tube 72 to the inlet of the air driven positive displacement pump 20. The pump 20 as here illustrated is a piston-type positive displacement pump having a suction 74 connected through an adjustable tube 76 positioned in a conventional drum 78 containing shotcrete accelerator. The pump 20 receives the air via line 72. The pump exhausts used compressed air through a conventional muffler 80.

The pump 20 has a discharge 82 which is supplied directly to an accumulator 84. The accumulator 84 is a conventional accumulator used to remove the pressure pulses or fluctuations associated with the output of the positive displacement pump. As known to those skilled in the art, a variety of accumulators may be used to reduce or minimize pressure fluctuation at the output of the accumulator 84. The accumulator 84 here illustrated is of the type having an internal piston separating the fluid (shotcrete accelerator) and an air pressure which is inserted through a nipple fitting 86. The output 88 of the accumulator 84 is connected to the flexible hose 18 for subsequent connection to the first inlet 38 of the manifold 28 at the applicator 12.

In operation, compressed air is supplied to the regulator 66 is adjusted by the operator to control the speed and in turn the output flow and pressure of the positive displacement pump 20. A lubricant is supplied by the lubricator 70 to lubricate the air driven pump 20. The pump 20 takes a suction from the drum 78 and supplies an output to the accumulator 84 which removes or substantially reduces pressure fluctuation in the flexible hose 18. The output pressure of the pump 20 is selected or adjusted to be slightly higher than the pressure of the shotcrete passing through the applicator 12 (FIG. 2). The compressed air via line 60 may vary from 25 pounds per square inch to 150 pounds per square inch.

To apply shotcrete with shotcrete accelerator intermixed therewith, the source of shotcrete (e.g., a centrifugal pump taking a suction on a barrel or reservoir of shotcrete slurry) is operated to supply a shotcrete slurry to the applicator 12 under pressure. The first source of compressed air is operated to supply compressed air to the regulator 66 via line 66. The regulator 66 is adjusted to operate the pump 20 at a speed to generate a rate of flow of shotcrete accelerator desired to be intermixed with the shotcrete. Similarly, the second source of compressed air is operated to supply compressed air to the second inlet 42 of the injection manifold 28. By adjusting the stop valves 40 and 44, the operator may make adjustments to the flow rate of the accelerator and compressed air to achieve optimum results during operation. The compressed air received through the second inlet 42 tends to atomize the shotcrete accelerator to improve the mixing of the accelerator with the shotcrete. Similarly, the compressed air tends to atomize the shotcrete which improves the intermixing of the shotcrete accelerator with the shotcrete as the shotcrete accelerator passes into the shotcrete within the applicator 12 through the outlets 50 and 52. The improved mixing effected by injecting the accelerator with air intermixed therewith into the shotcrete in the applicator results in a more uniform mixing at or just prior to its exit from the venturi tip 36 so that the shotcrete as applied to surfaces experiences less rebound, dripping and the like. Further, the set time of the shotcrete as applied is reduced improving the adhesive characteristics of the shotcrete.

It may be noted that the first source of compressed air 24 and second source of compressed air 30 may be in fact one single air compressor having dual outlets. A conventional air compressor acting as the first and second source of compressed air may be any one of a variety of different compressors capable of supplying compressed air at an output pressure between 25 pounds per square inch and 150 pounds per square inch.

It is to be understood that the embodiments of the invention herein described are merely illustrative of the application of the principles of the invention. Reference herein to details of the illustrated embodiments is not intended to limit the scope of the claims which themselves recite those features regarded as essential to the invention.

I claim:

1. A method of injecting shotcrete accelerator into a flowing shotcrete slurry prior to application thereof by and through a shotcrete applicator connected to receive said shotcrete slurry under pressure, said method being comprised of:

supplying shotcrete accelerator to said applicator at a pressure in excess of the pressure of said shotcrete slurry as it passes through said applicator;

supplying compressed air to said applicator at a pressure in excess of the pressure of said shotcrete slurry as it passes through said applicator;

intermixing said shotcrete accelerator and said compressed air together in the vicinity of said applicator; and injecting the mixture of said accelerator and said compressed air into the shotcrete slurry in said applicator to intermix therewith as said shotcrete passes through said applicator.

2. The method of claim 1 wherein the shotcrete accelerator is supplied at a substantially constant rate of flow and pressure.

3. The method of claim 2 wherein said rate of flow and the pressure of said shotcrete accelerator are adjustable.

4. The method of claim 3 wherein the compressed air is supplied at a substantially constant pressure and rate of flow.

5. The method of claim 4 wherein the pressure and rate of flow of said compressed air are adjustable.

6. The method of claim 5 wherein said shotcrete accelerator is supplied from a source comprised of a reservoir of shotcrete accelerator and a positive displacement air driven pump having an accumulator connected to its output.

7. The method of claim 6 wherein said pump is driven by an external source of compressed air from about 25 pounds per square inch to about 150 pounds per square inch supplied through an adjustable pressure regulator.

8. Apparatus for applying shotcrete comprised of:

a source of shotcrete under pressure;

a source of shotcrete accelerator;

first and second sources of compised air;

an air driven positive displacement pump connected to said first source of compressed air to be driven thereby and positioned and connected to take a suction from said source of shotcrete accelerator and to supply shotcrete accelerator under pressure at its output;

an accumulator having an inlet and an outlet, said inlet being connected to receive the output of said pump;

a shortcrete applicator connected to the source of shotcrete to receive shotcrete under pressure therefrom;

an accelerator injection manifold positioned along the length of said applicator, said manifold having:

a first inlet connected to the outlet of said accumulator to receive shotcrete accelerator therefrom, a second inlet connected to said second source of compressed air to receive compressed air therefrom, a body in which said compressed air and said shotcrete accelerator are intermixed, and a plurality of outlets connected to said applicator to inject the mixture of compressed air and shotcrete accelerator into the shotcrete in said applicator.

9. The apparatus of claim 8 wherein said manifold has:

a first valve connected at said first inlet to regulate and stop the flow of said shotcrete accelerator;

a second valve connected at said second inlet to regulate and stop the flow of said compressed air; and two said outlets positioned approximately diametrically opposite each other.

10. The apparatus of claim 9 wherein said first and second sources of compressed air is compressed air from about 25 pounds per square inch to about 150 pounds per square inch pressure.

11. The apparatus of claim 10 further comprising an adjustable pressure regulator connected to receive compressed air from said first source thereof and to supply regulated compressed air to said pump, said regulator having filter means to filter said compressed air regulator means to regulate the flow of said compressed air to said pump and in turn the speed and output thereof, and lubricator means to inject lubricant into said regulated compressed air to lubricant said pump.

12. The apparatus of claim 11 wherein said pump has an exhaust to exhaust used compressed air and a muffler affixed to said exhaust to quiet said exhaust, said source of shotcrete accelerator is a conventional drum filled with said accelerator, and said pump is positioned on top of said drum and said pump suction is an adjustable tube extending substantially to the bottom of said drum.

* * * * *